US011135697B2

(12) United States Patent
Duncan et al.

(10) Patent No.: US 11,135,697 B2
(45) Date of Patent: Oct. 5, 2021

(54) TOOL FOR REPAIRING AND APPLYING TEXTURE TO SURFACES

(71) Applicants: Jacob Alan Duncan, Citrus Springs, FL (US); Arbuth Bumgarner, Hernando, FL (US)

(72) Inventors: Jacob Alan Duncan, Citrus Springs, FL (US); Arbuth Bumgarner, Hernando, FL (US)

(73) Assignee: HERNANDO MOSS INC., Hernando, FL (US)

( * ) Notice: Subject to any disclaimer, the term of this patent is extended or adjusted under 35 U.S.C. 154(b) by 0 days.

(21) Appl. No.: 16/947,343

(22) Filed: Jul. 29, 2020

(65) Prior Publication Data

US 2020/0406419 A1 Dec. 31, 2020

Related U.S. Application Data

(60) Provisional application No. 62/867,266, filed on Jun. 27, 2019.

(51) Int. Cl.
*B05C 17/10* (2006.01)
*B24B 29/00* (2006.01)

(52) U.S. Cl.
CPC ..... *B24B 29/00* (2013.01); *B05C 17/10* (2013.01)

(58) Field of Classification Search
USPC ..... 118/211; 15/244.1, 145, 235.4; 492/13, 492/19, 37
See application file for complete search history.

(56) References Cited

U.S. PATENT DOCUMENTS

| | | | | |
|---|---|---|---|---|
| 5,037,011 | A | 8/1991 | Woods | |
| 5,188,263 | A | 2/1993 | Woods | |
| 5,310,095 | A | 5/1994 | Stern et al. | |
| 5,443,211 | A | 8/1995 | Young et al. | |
| 5,695,788 | A | 12/1997 | Woods | |
| 5,771,525 | A | 6/1998 | Fulcher et al. | |
| 6,112,945 | A | 9/2000 | Woods | |
| 6,225,393 | B1 | 5/2001 | Woods | |
| 6,386,402 | B1 | 5/2002 | Woods | |
| 6,913,407 | B2 | 7/2005 | Greer et al. | |
| 9,889,464 | B1 | 2/2018 | Winne | |
| 2002/0001636 | A1 | 1/2002 | Holloway | |
| 2002/0134044 | A1 | 9/2002 | Dove | |
| 2005/0095968 | A1* | 5/2005 | Mick | B24D 15/023 451/523 |
| 2008/0229535 | A1 | 9/2008 | Walter | |
| 2009/0031518 | A1 | 2/2009 | Salvino | |
| 2011/0117277 | A1 | 5/2011 | Renner et al. | |

* cited by examiner

*Primary Examiner* — Yewebdar T Tadesse
(74) *Attorney, Agent, or Firm* — Dunlap Bennett & Ludwig, PLLC

(57) ABSTRACT

A handheld texturing tool to apply or reapply joint compound in deficient areas of a larger textured surface so that a new texture can be rendered to the deficient areas without disturbing the larger textured surface.

3 Claims, 3 Drawing Sheets

TOOL FOR REPAIRING AND APPLYING TEXTURE TO SURFACES

CROSS-REFERENCE TO RELATED APPLICATION

This application claims the benefit of priority of U.S. provisional application No. 62/867,266, filed 27 Jun. 2019, the contents of which are herein incorporated by reference.

BACKGROUND OF THE INVENTION

The present invention relates to repairing damaged surfaces and more particularly to a tool for repairing damaged textures of drywall ceilings and walls.

Knockdown texture is a drywall finishing style resulting in a mottled texture. Knockdown texture is created by watering down joint compound to a soupy consistency. Typically, a trowel is then used to apply the joint compound. The joint compound will begin to form stalactites as it dries. The trowel is then run over the surface of the drywall, knocking off the stalactites and leaving the mottled finish.

The knockdown texture can develop cracks, water damage, and stains over time. For instance, drywall tape becomes loose due to humidity and heat, and this loosening can result in damage to the knockdown texture.

Current devices used for such repairs do not allow for a handheld option for direct delivery and precise repairs. Air delivery devices are used for a much wider surface area, which causes excess coverage and an inconsistent surface textures due to, among other things, the differences in the composition between the previous joint compound and the new, overlapping joint compound and the changes between such compounds due to the passage of time.

As can be seen, there is a need for a handheld tool for precisely repairing damaged areas of surface texture, including but not limited to knockdown texture.

SUMMARY OF THE INVENTION

In one aspect of the present invention, a handheld texturing tool includes the following: a handle having a bottom surface; a plurality of spaced apart pads protruding from the bottom surface; each pad having a plurality of nubs protruding from an operative surface of the pad; and each nub defining one or more recesses, wherein over ninety percent of the recesses are irregularly shaped, wherein each nub is made of a material that engenders a plasticity of a joint compound in such a way to form stalactites of the joint compound engaging a surface.

In another aspect of the present invention, a method of selectively applying a texture to a repair surface within a textured surface, the method including the following: providing the above-mentioned handheld texturing tool; engaging a joint compound with the plurality of nubs; and dabbing the plurality of nubs along the repair surface in such a way to form a plurality of stalactites of the joint compound engaging the repair surface.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a handheld texturing tool to apply or reapply joint compound in deficient areas of a larger textured surface so that a new texture can be rendered to the deficient areas without disturbing the larger textured surface.

Referring now to FIGS. 1 through 5D, the present invention may include a handheld texturing tool 30 to apply texture to surfaces, such as ceilings and walls. The present invention may used to create a texture 28 including but not limited to knockdown effect textures on the surface 16.

Figure 1:
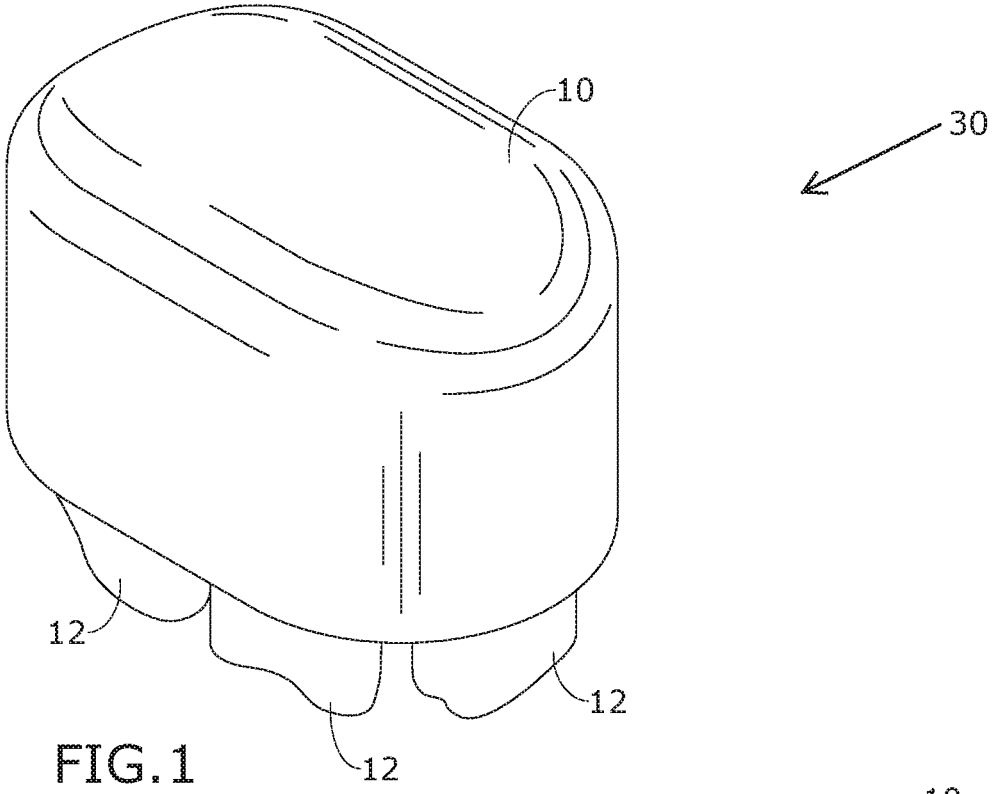
FIG. 1 is a top perspective view of an exemplary embodiment of the present invention.
Figure 2:
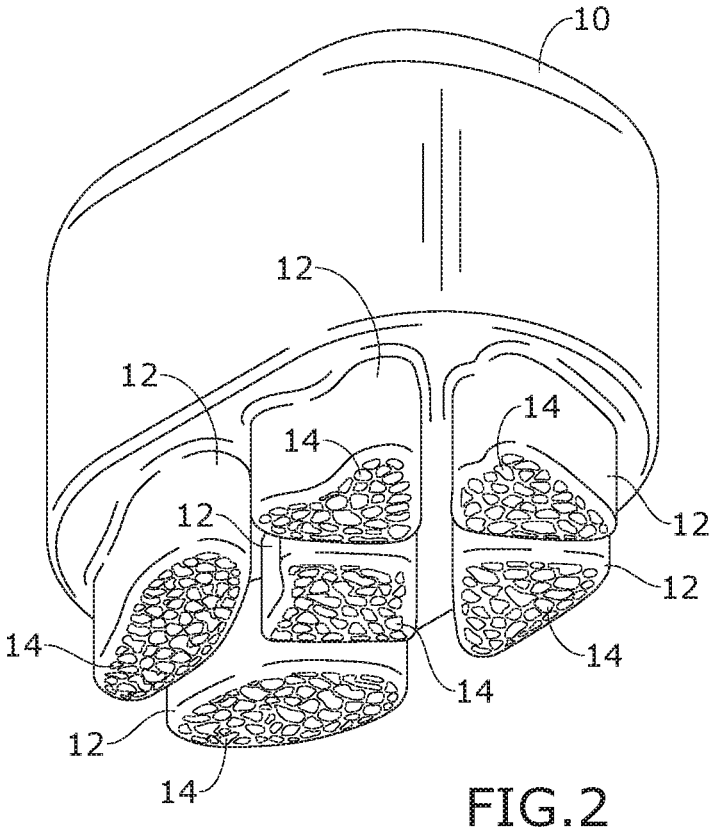
FIG. 2 is a bottom perspective view of an exemplary embodiment of the present invention.
Figure 3:
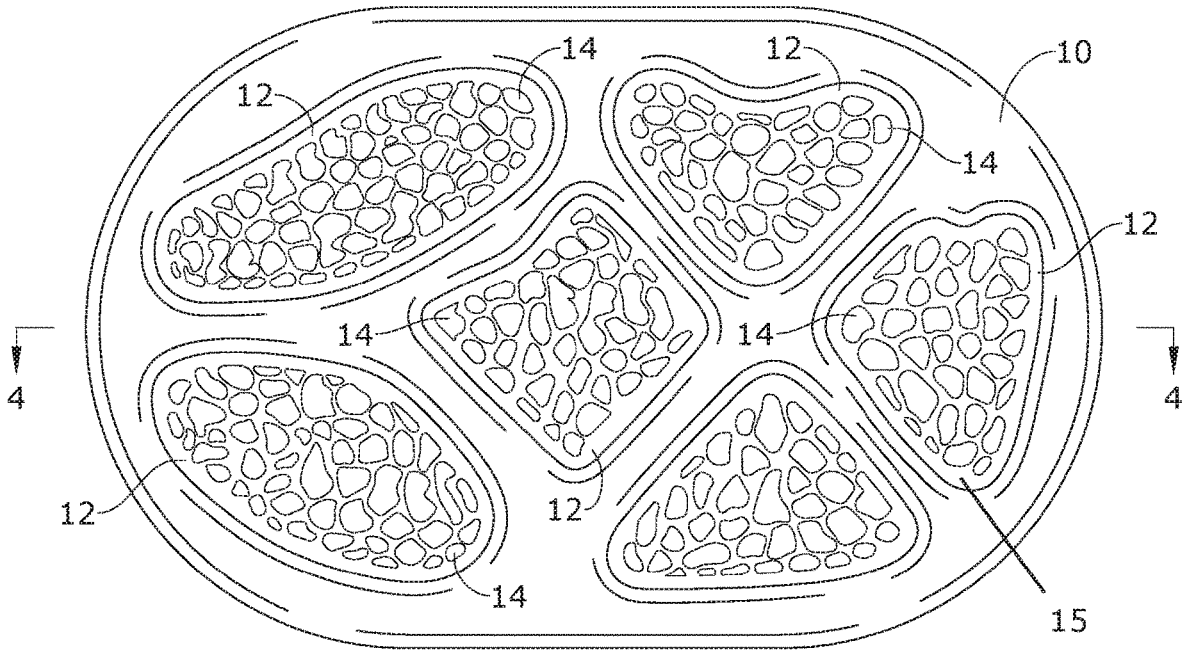
FIG. 3 is a bottom elevation view of an exemplary embodiment of the present invention.
Figure 4:
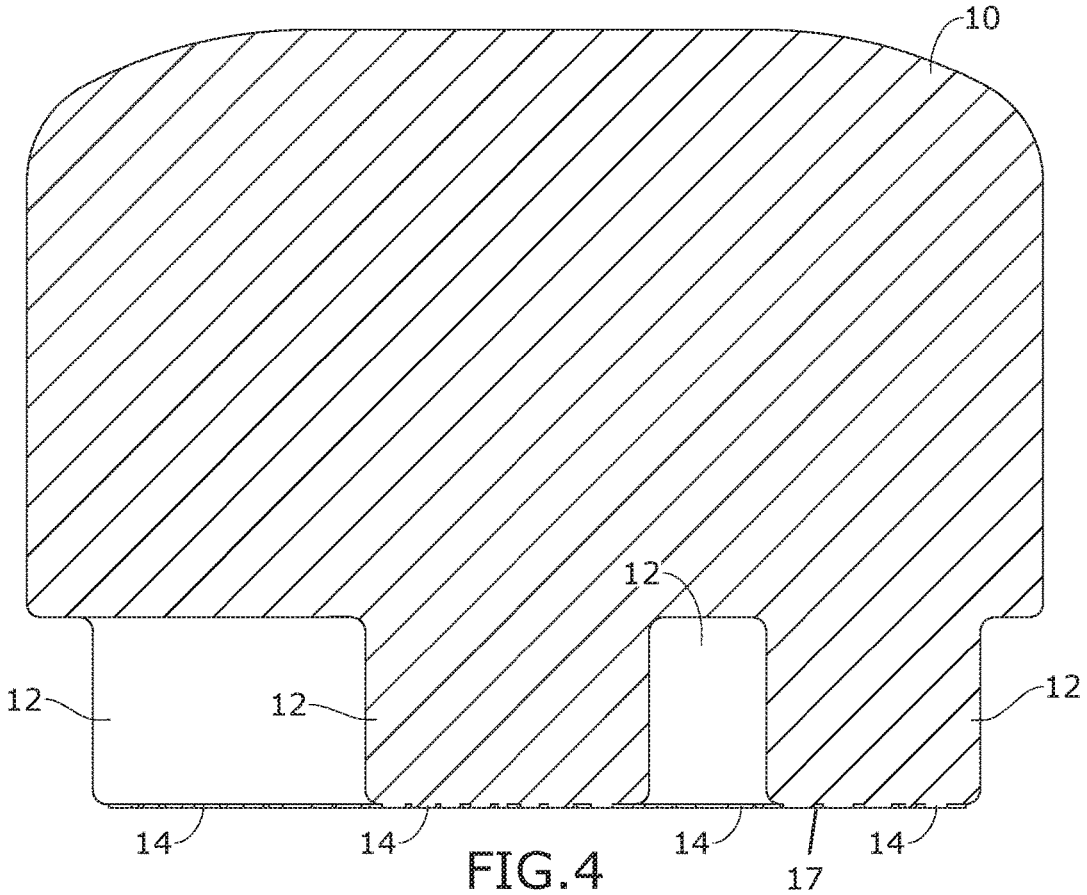
FIG. 4 is a section view of an exemplary embodiment of the present invention, taken along line 4-4 of FIG. 3.
Figure 5A:
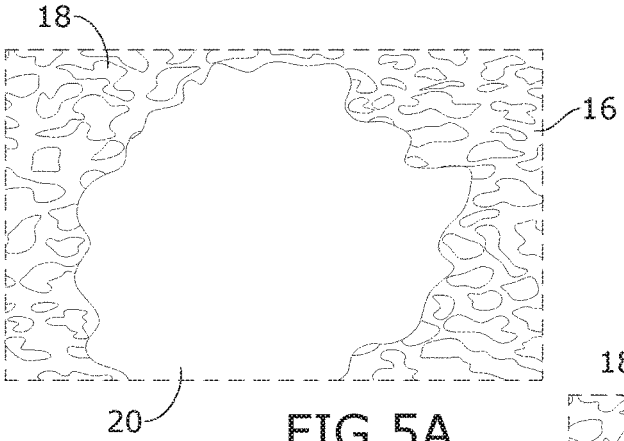
FIG. 5A is a schematic view of an exemplary embodiment of the present invention, illustrating an area of drywall ready for texture.
Figure 5B:
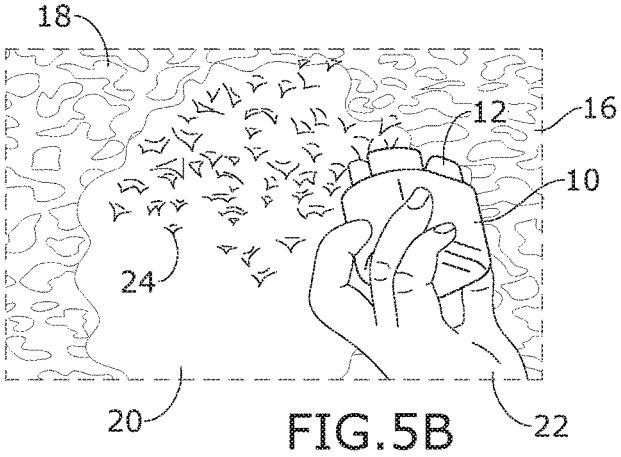
FIG. 5B is a schematic view of an exemplary embodiment of the present invention, illustrating an application of joint compound 24 to the area of drywall.
Figure 5C:
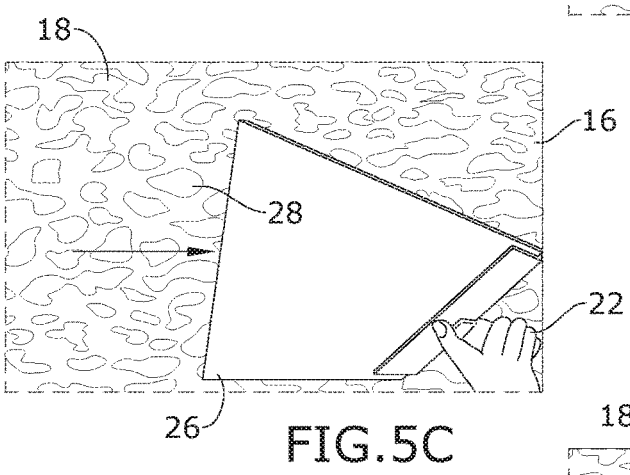
FIG. 5C is a schematic view of an exemplary embodiment of the present invention, illustrating the knocking down of the applied joint compound 24 with a texturing tool 26.
Figure 5D:
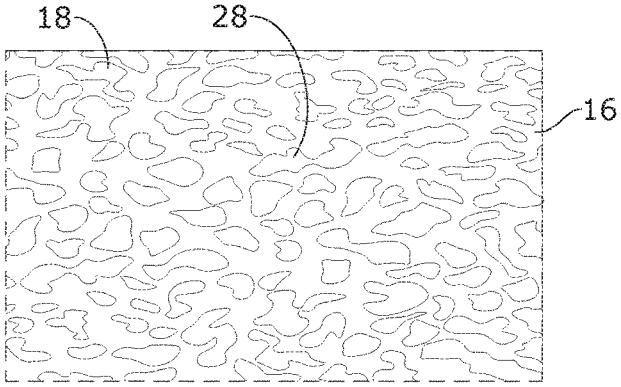
FIG. 5D is a schematic view of an exemplary embodiment of the present invention, illustrating the area of drywall with new texture applied.

The handheld texturing tool 30 may be designed with a plurality of patterned pads 12 that protrude from a lower surface of the handle 10. Adjacent pads 12 may be spaced apart by irregular distances, as illustrated in FIG. 3. Each pad 12 may have an operative surface 15 from which a plurality of nubs 14 protrude further away from the lower surface of the handle 10. Each nub 14 has one or more adjacent recesses 17 extending toward said lower surface. The plurality of nubs 14 may have irregular shapes and most likely a different shape relative to adjacent nubs 14. The nubs 14 may be made of foam or other materials with the tendency to engage joint compound 24 sufficiently to engender the plasticity of joint compound 24; specifically, for forming stalactites, as illustrated in FIG. 5B.

The patterned pads 12 allow for direct application of joint compound 24, including but not limited to drywall mud, to the problem area 20 on a surface 16. The surface 16 can be but is not limited to drywall. The handheld texturing tool 10 allows for a convenient process to seal, cover, and texturize a problem area 20 selectively along the surface 16.

A method of using the present invention may include the following. The handheld texturing tool 30 disclosed above may be provided. A user 22 wanting to repair a deficient or damaged area 20 within a larger textured surface 16 engages joint compound 24 with the plurality of pads 12 and dabs the joint compound 24 along the deficient area 20 until joint compound 24 stalactites form. After the stalactites sufficiently dry the user 22 may apply a texturing tool 26, such as a trowel, in such a way to form new knockdown texture 28.

The handheld texturing tool 30 provides for a convenient process to seal, cover, and texturize the problem area 20. The present invention allows for a faster and cost-effective handheld process for professionals and homeowners. The present invention may be used for resurfacing inside and outside of structures.

The present invention may be made using a mold and injecting a liquid foam into the mold. The foam may be allowed to dry and the foam tool is removed for use. In alternate embodiments, the present invention may include a two-part tool, which may be used to interchange the handle size, pad size, or pad shape.

It should be understood, of course, that the foregoing relates to exemplary embodiments of the invention and that modifications may be made without departing from the spirit and scope of the invention as set forth in the following claims.

What is claimed is:

1. A handheld texturing tool, comprising:

a handle having a bottom surface;

a plurality of spaced apart pads protruding from the bottom surface;

each of the plurality of spaced apart pads having a plurality of nubs and an operative surface, wherein the plurality of nubs protruding from the operative surface of each of the plurality of spaced apart pads; and each nub defining one or more recesses, wherein over ninety percent of the one or more recesses are irregularly shaped.

2. The handheld texturing tool of claim 1, wherein each nub is made of foam.

3. The handheld texturing tool of claim 1, wherein each nub is made of a material that engenders a plasticity of a joint compound in such a way to form stalactites of the joint compound engaging a surface.

* * * * *